US009033417B2

(12) United States Patent
Mo

(10) Patent No.: US 9,033,417 B2
(45) Date of Patent: May 19, 2015

(54) CHILD CHAIR APPARATUS

(71) Applicant: Xiao-Long Mo, Guangdong (CN)

(72) Inventor: Xiao-Long Mo, Guangdong (CN)

(73) Assignee: BP Children's Products HK Co., Limited, Kwai Chung, N.T. (HK)

( * ) Notice: Subject to any disclaimer, the term of this patent is extended or adjusted under 35 U.S.C. 154(b) by 174 days.

(21) Appl. No.: 13/717,730

(22) Filed: Dec. 18, 2012

(65) Prior Publication Data

US 2013/0154327 A1 Jun. 20, 2013

(30) Foreign Application Priority Data

Dec. 19, 2011 (CN) ..... 2011 1 0427961

(51) Int. Cl.
*A47D 1/08* (2006.01)
*A47D 1/00* (2006.01)

(52) U.S. Cl.
CPC ..... *A47D 1/002* (2013.01); *A47D 1/004* (2013.01); *A47D 1/08* (2013.01); *A47D 1/008* (2013.01)

(58) Field of Classification Search
CPC ..... A47D 1/002; A47D 1/004; A47D 1/008; A47D 1/08
USPC ..... 297/148, 149, 151, 153, 354.2, 317, 297/318, 322, 340, 341, 342, 343
See application file for complete search history.

(56) References Cited

U.S. PATENT DOCUMENTS

| | | | | |
|---|---|---|---|---|
| 3,124,388 | A * | 3/1964 | Berlin | 297/320 |
| 4,394,046 | A | 7/1983 | Irwin | |
| 5,810,440 | A * | 9/1998 | Unwalla | 297/316 |
| 6,347,833 | B1 * | 2/2002 | Chen | 297/328 |
| 8,287,044 | B2 * | 10/2012 | Chen et al. | 297/327 |
| 2013/0257124 | A1 * | 10/2013 | Mo | 297/260.1 |

FOREIGN PATENT DOCUMENTS

| | | | |
|---|---|---|---|
| EP | 1 593 323 | A1 | 11/2005 |
| EP | 2 078 478 | A1 | 7/2009 |
| FR | 2.185.188 | | 12/1973 |

* cited by examiner

*Primary Examiner* — David R Dunn
*Assistant Examiner* — Jody Giacoman
(74) *Attorney, Agent, or Firm* — Winston Hsu; Scott Margo

(57) ABSTRACT

A child chair apparatus includes a supporting device and a seat device. The seat device is disposed on the supporting device. The seat device includes a fixing component and a seat component. The fixing component is disposed on the supporting device. The fixing component includes a first shaft and a second shaft. The seat component includes an oscillating base and an adjusting base. The oscillating base and the adjusting base are slidably connected to the first shaft and the second shaft respectively, such that the seat component is slidably disposed on the fixing component. The child chair apparatus of the present invention can be switched between the high chair and rocking chair, and has advantages of easy operation and convenient usage.

18 Claims, 14 Drawing Sheets

CHILD CHAIR APPARATUS

BACKGROUND OF THE INVENTION

1. Field of the Invention

The present invention relates to a child chair apparatus, and more particularly, to a child chair apparatus capable of being a rocking chair.

2. Description of the Prior Art

Child is shorter than adult. A high chair or a child chair with specific specification is utilized to help the child sitting besides the adult, who sits on the conventional chair that is not suitable for the child. A foldable child chair capable of folding and unfolding according to actual demand is carried conveniently. Volume of the foldable child chair can be decreased for easy storage, and the foldable child chair becomes popular in the market. However, the conventional child chair includes a seat and a supporter whereon the seat is disposed. The supporter includes a front foot and a rear foot, and the front foot is pivotally connected to the rear foot. The conventional child chair can be folded and unfolded according to user's demand, and the conventional child chair is the high chair. The child may feel comfortable when sitting on the oscillatory chair, the conventional child high chair is immovable and can not provide additional oscillatory function to the child. Therefore, design of a child chair capable of being the immovable chair and the oscillatory chair and having advantages of easy operation and convenient usage is an important issued in the related industry.

SUMMARY OF THE INVENTION

The present invention provides a child chair apparatus capable of being a rocking chair and having advantages of easy operation and convenient usage for solving above drawbacks.

According to the claimed invention, a child chair apparatus includes a supporting device and a seat device. The seat device is disposed on the supporting device. The seat device includes a fixing component and a seat component. The fixing component is disposed on the supporting device. The fixing component includes a first shaft and a second shaft. An oscillating base and an adjusting base are disposed on a side of the seat component. The oscillating base and the adjusting base are slidably connected to the first shaft and the second shaft respectively, such that the seat component is slidably disposed on the fixing component.

According to the claimed invention, the oscillating base and the adjusting base have an oscillating slot and a sliding slot respectively, and the first shaft and the second shaft are slidably inserted in the oscillating slot and the sliding slot respectively.

According to the claimed invention, the seat device further includes a constraining component and a control mechanism. The constraining component is movably connected to the seat component and operatively interfered with the first shaft, so as to constrain a slide of the first shaft relative to the oscillating slot. The control mechanism is operatively connected to the constraining component to move the constraining component, so as to drive the constraining component to be interfered with the first shaft. The oscillating slot is formed on the oscillating base, and the first shaft is disposed inside the oscillating slot. The control mechanism controls the constraining component to unlock the first shaft, and the seat component can slide relative to the first shaft and the second shaft for oscillation.

According to the claimed invention, the control mechanism includes a second resilient component, a second cable and a controlling component. The controlling component is connected to the constraining component via the second cable. The second resilient component has a trend of driving the constraining component to move to an interfering position where the constraining component is interfered with the first shaft. The controlling component drives the constraining component to move away from the interfering position via the second cable. By utilization of the second resilient component and the second cable, the second cable is pulled to drive the constraining component to move out of the oscillating slot. The second resilient component drives the constraining component to automatically move back to the oscillating slot when the second cable is released, so as to lock and unlock the first shaft.

According to the claimed invention, the constraining component is pivotally connected to the seat component, so as to be driven to move to or move away from the interfering position.

According to the claimed invention, the controlling component includes a control unit, a safety button and a positioning portion. The positioning portion is fixed on the seat component and has two positioning holes. The control unit is pivotally connected to the positioning portion and connected to the second cable. Positioning holes are formed on a front end and a rear end of the positioning portion. The safety button is slidably disposed on the control unit and selectively engaged with the two positioning holes formed. The control unit rotates relative to the positioning portion to pull the second cable. The positioning hole is formed on the positioning portion, and the safety button is utilized to engage with the positioning hole, so as to lock the control unit.

According to the claimed invention, the controlling component further includes a recovering spring contacting against the control unit and the safety button, and the recovering spring has a trend of driving the safety button to be selectively engaged with the two positioning holes. The resilient force of the recovering spring is utilized to engage the safety button with the positioning hole, so as to prevent the safety button from accidently separating from the positioning hole. The control unit is rotatable when the safety button is separated from the positioning hole, and the seat component is unable to oscillate.

According to the claimed invention, the seat device further includes a back adjusting mechanism disposed on the seat component. The fixing component further includes an engaging member. The back adjusting mechanism is capable of being engaged with the engaging member when the constraining component is interfered with the first shaft, such that the seat component is fixed on the fixing component at a predetermined inclined angle.

According to the claimed invention, the back adjusting mechanism includes a back adjusting component, a first resilient component and a handle. The first resilient component contacts against the seat component and the back adjusting component. The first resilient component has a trend of driving the back adjusting component to be engaged with the engaging member of the fixing component. The handle and the first cable are slidably disposed on the seat component and connected to the back adjusting component via the first cable, so as to drive the back adjusting component to be disengaged from the engaging member.

According to the claimed invention, the back adjusting component has a plurality of engaging holes. The engaging member is selectively engaged with one of the engaging holes fix relative position between the back adjusting component and the fixing component.

According to the claimed invention, the back adjusting component further has a track slot communicated with one of the engaging holes, the engaging member is capable of sliding inside the track slot.

According to the claimed invention, the seat component has an accommodating slot, and the back adjusting component is accommodated in the accommodating slot. Because the back adjusting component is selectively engaged with the engaging member, the back adjusting component can be accommodated inside the accommodating slot when the back adjusting component is separated from the engaging member, so as to constrain a position of the back adjusting component and to prevent the engaging member and the engaging hole on the back adjusting component from alignment.

According to the claimed invention, the sliding slot includes a first sliding slot and a second sliding slot. The second sliding slot is communicated with the first sliding slot. A structural direction of the first sliding slot is different from a structural direction of the second sliding slot. The second shaft is capable of sliding in the second sliding slot when the constraining component is interfered with the first shaft, such that the seat component rotates relative to the fixing component via the first shaft.

Comparing to the prior, an oscillating base and an adjusting base are disposed on a side of the seat component in the present invention. The fixing component includes the first shaft and the second shaft, the oscillating base and the adjusting base are slidably connected to the first shaft and the second shaft respectively, such that the seat component can slide relative to the fixing component. The child chair apparatus of the present invention can be switched to the rocking chair, and has advantages of easy operation and convenient usage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
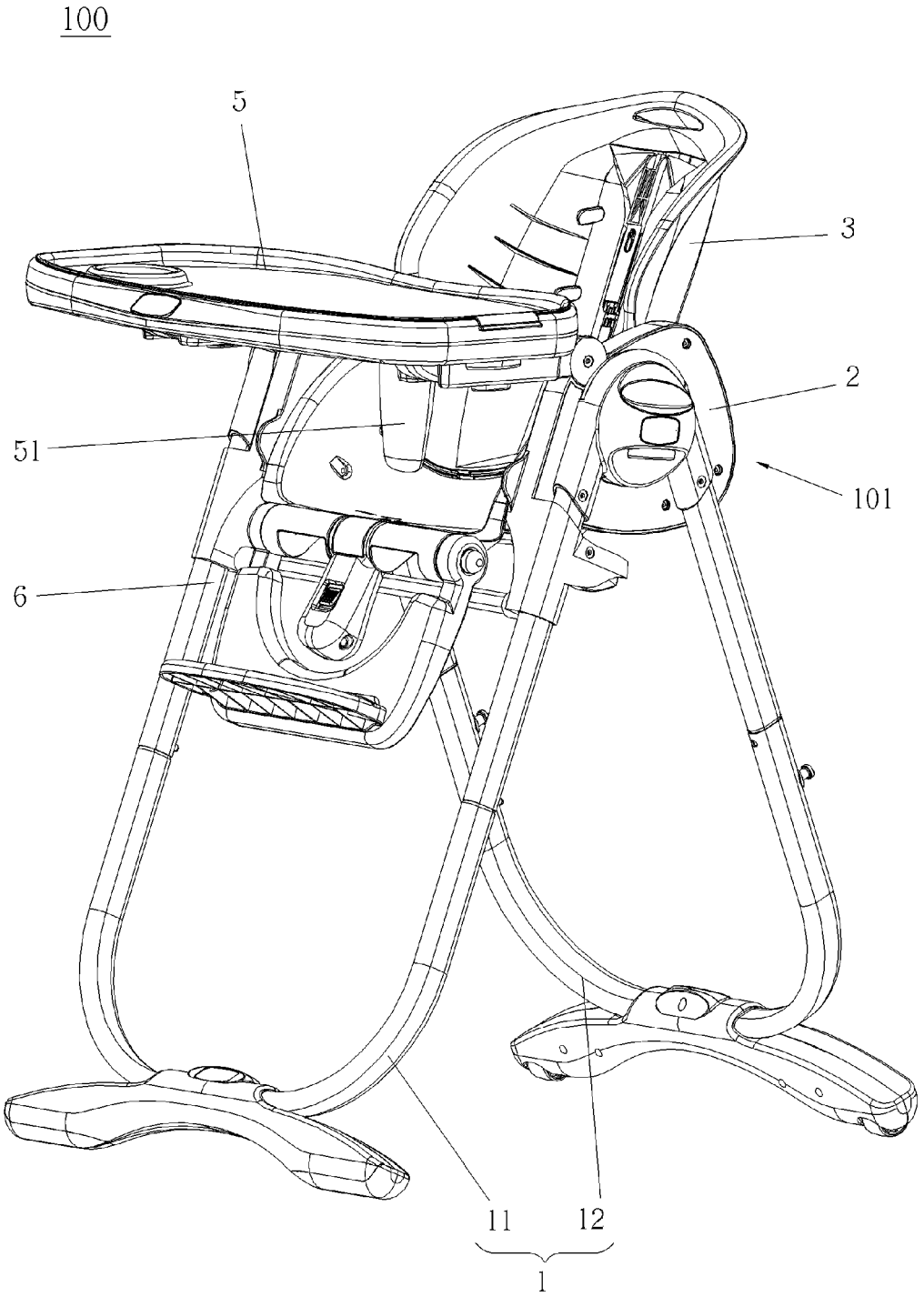
FIG. 1 is a structural diagram of a child chair apparatus according to an embodiment of the present invention.
Figure 2:
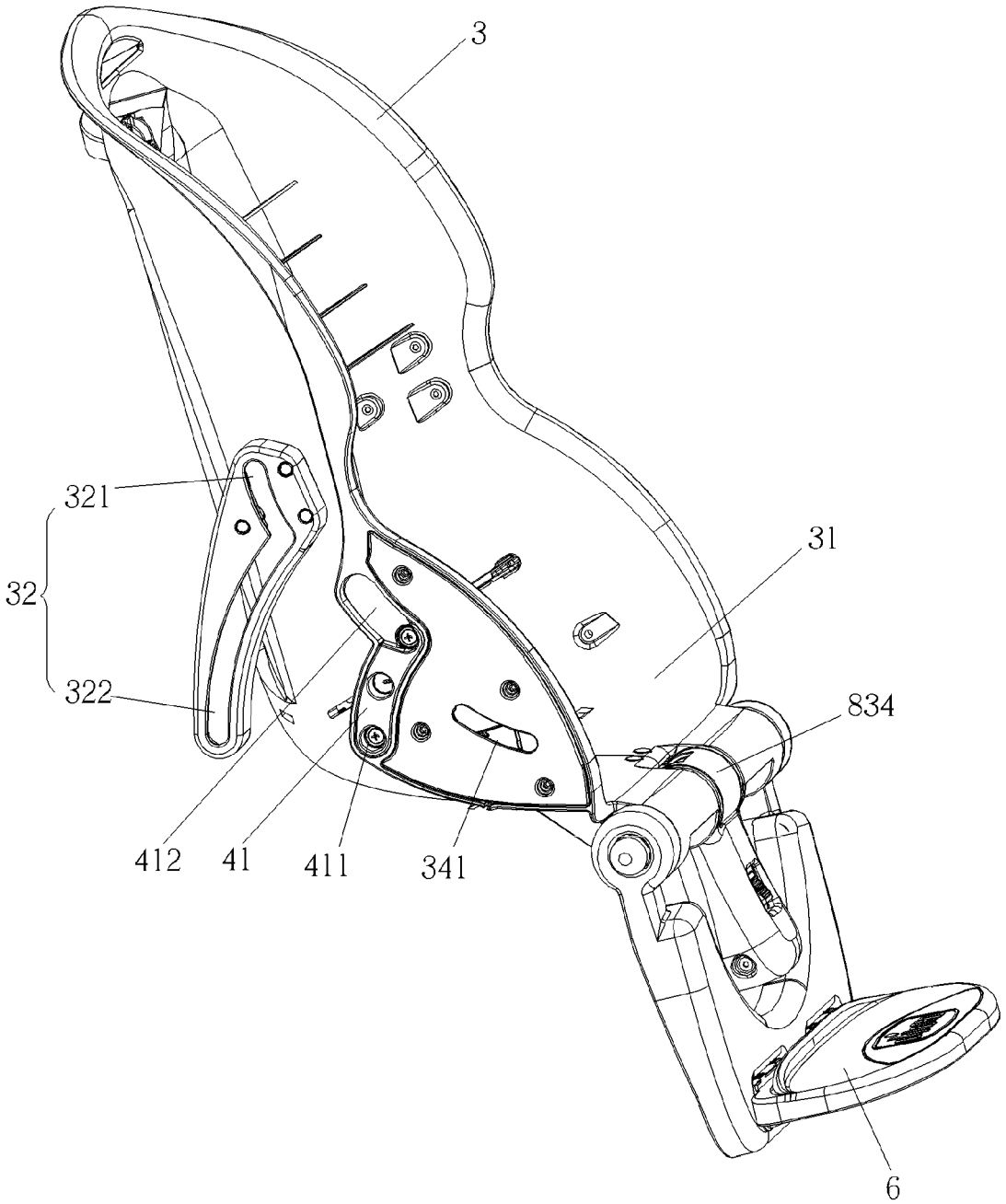
FIG. 2 is a structural diagram of a back adjusting mechanism and a seat component according to the embodiment of the present invention.
Figure 3:
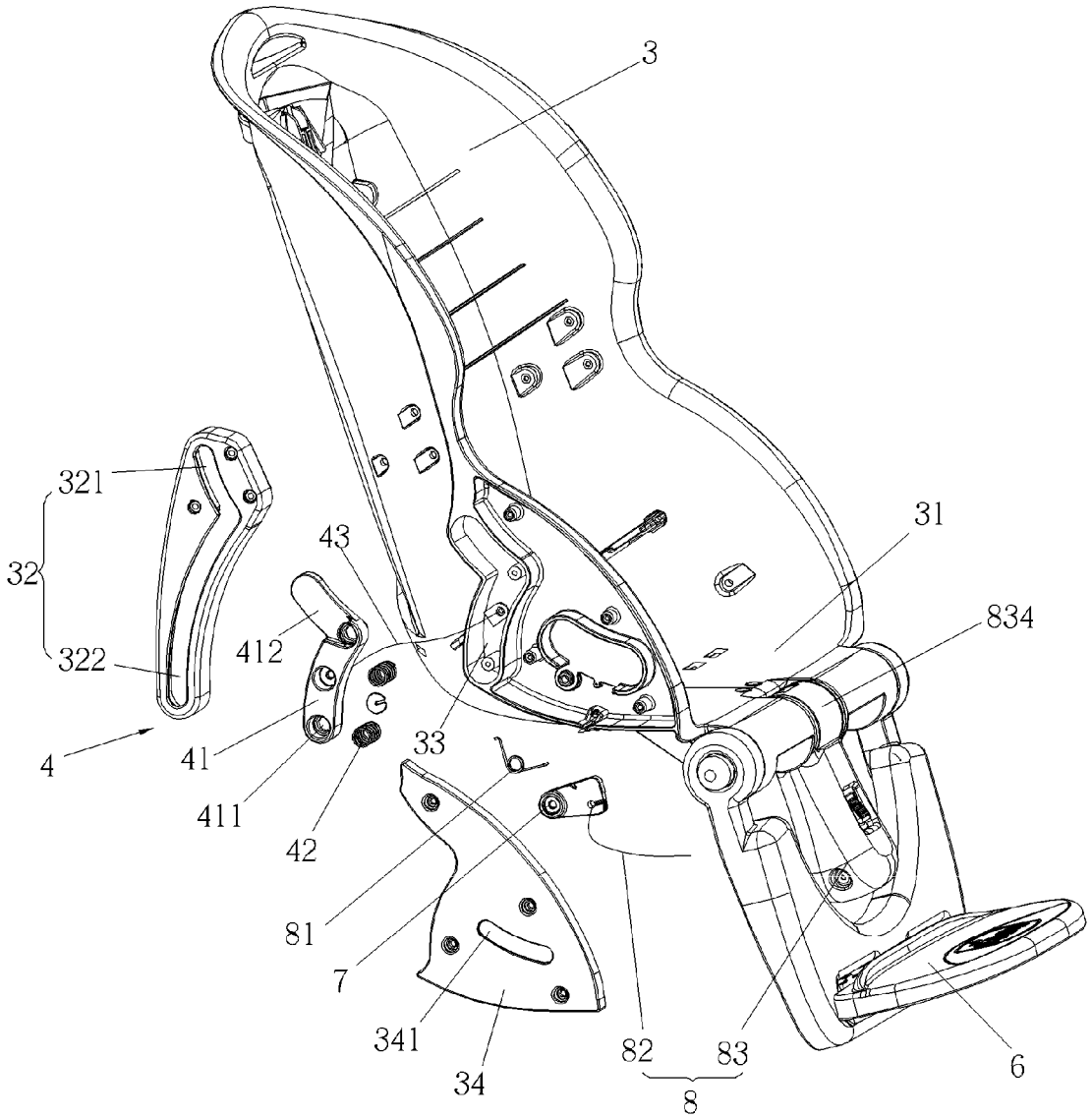
FIG. 3 is an exploded diagram of the back adjusting mechanism and the seat component according to the embodiment of the present invention.
Figure 4:
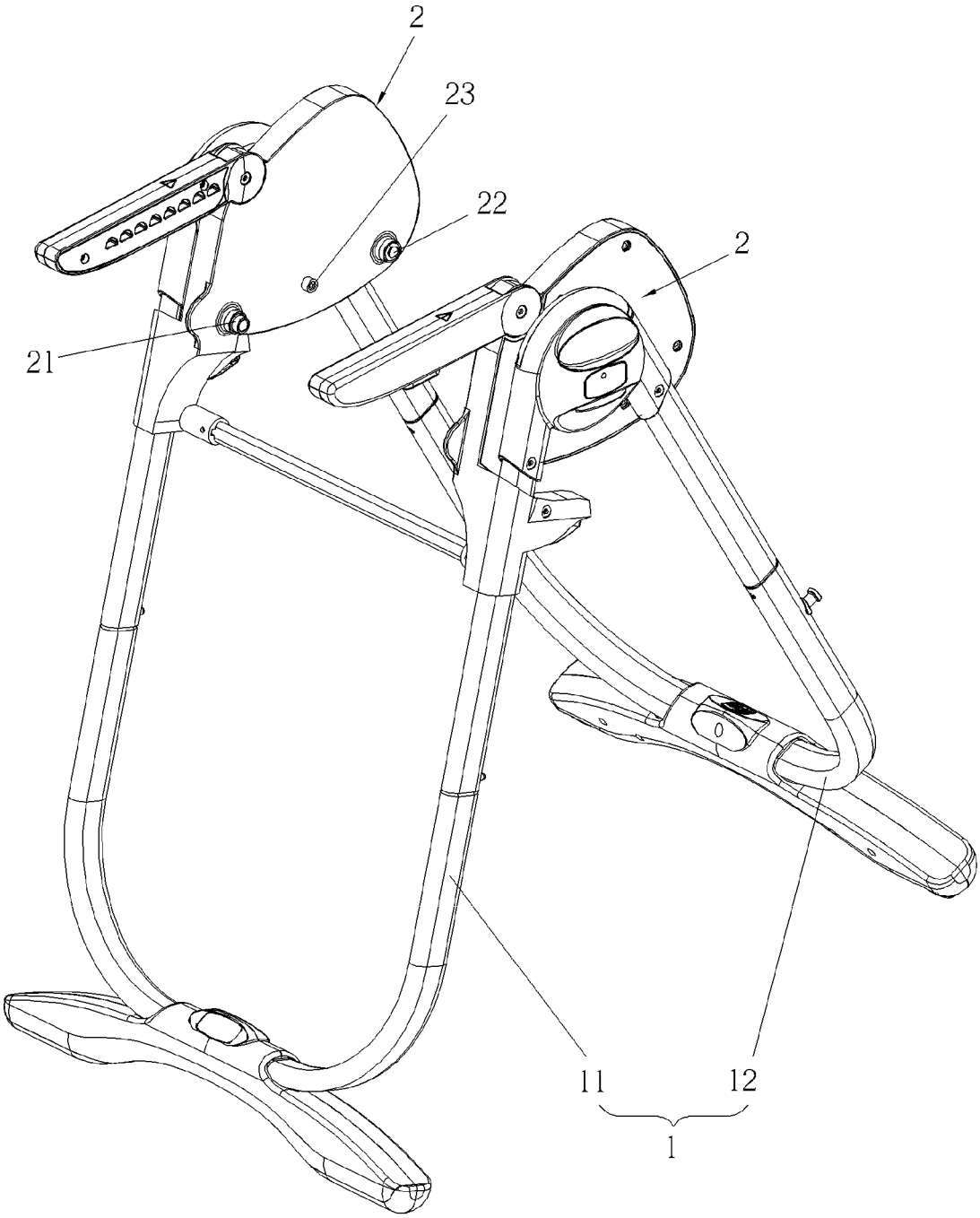
FIG. 4 is a diagram of a fixing component and a supporting device according to the embodiment of the present invention.
Figure 5:
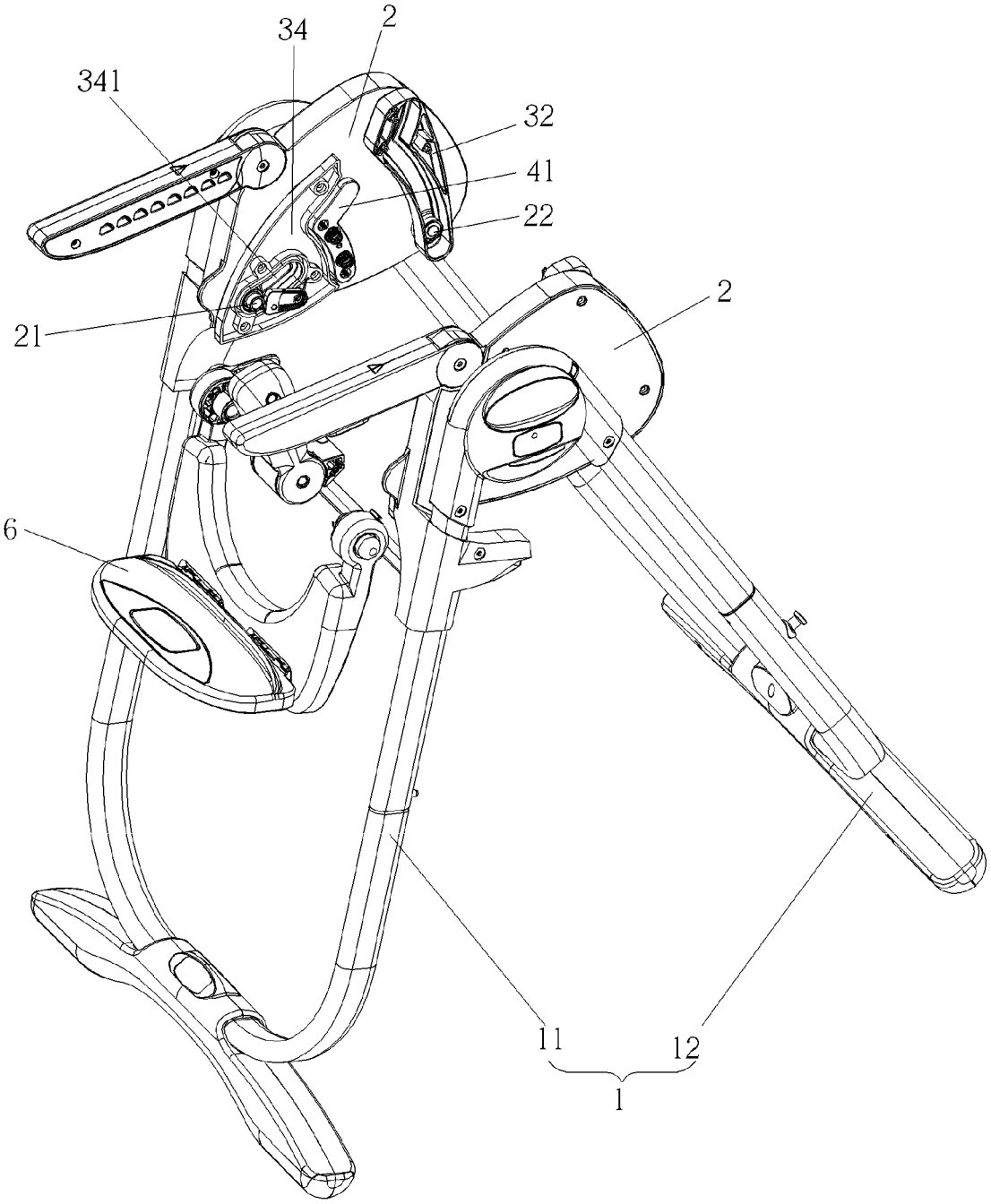
FIG. 5 is a structural diagram of the back adjusting mechanism and the fixing component according to the embodiment of the present invention.

Please refer to FIG. 1. The child chair apparatus 100 of the present invention includes a supporting device 1 and a seat device 101 disposed on the supporting device 1. The seat device 101 includes two fixing components 2, a seat component 3 and two back adjusting mechanisms 4. The supporting device 1 includes a pair of front foots 11 and a pair of rear foots 12. The front foots 11 are pivotally connected to the rear foots 12. A sleeve is disposed under the fixing component 2. The sleeve is slidably disposed on the front foot 11, such that a height of the seat device 101 relative to the supporting device 1 can be adjusted. The seat component 3 slidably pivots between the fixing components 2. The seat component 3 includes a seat portion 31, a tray 5 disposed on a front of the seat portion 31, and a leg-rest component 6 disposed on a front edge of the seat portion 31. The back adjusting mechanisms 4 are respectively disposed on two sides of the seat component 3. The back adjusting mechanism 4 can be utilized to adjust a predetermined inclined angle of the seat component 3 relative to the fixing component 2.

As shown in FIG. 2 to FIG. 5, the back adjusting mechanism 4 includes a back adjusting component 41, a first resilient component 42 and a first cable 43. The first cable 43 can be made of steel material. The fixing component 2 includes a first shaft 21, a second shaft 22 and an engaging member 23. The seat component 3 is slidably connected to the fixing component 2 via the first shaft 21 and the second shaft 22. The seat component 3 includes adjusting bases 32. The two adjusting bases 32 are disposed on two sides of the seat component 3. A sliding slot is formed on the adjusting base 32, which is disposed on a rear end of the seat component 3. The sliding slot includes a first sliding slot 321 and a second sliding slot 322. The second sliding slot 322 is communicated with the first sliding slot 321, and a structural direction of the second sliding slot 322 is different from a structural direction of the first sliding slot 321. The second sliding slot 322 is an arc structure. The first shaft 21 and the second shaft 22 are slidably inserted in the second sliding slot 322. The first shaft 21 is located at a front end of the seat component 3. The seat component 3 slidably pivots to the fixing component 2 via the first shaft 21, so that the seat component 3 can rotate relative to the fixing component 2. In the embodiment, the first resilient component 42 can be a compression spring. Two ends of the first resilient component 42 respectively contact against the seat component 3 and the back adjusting component 41. The first resilient component 42 drives the back adjusting component 41 to move toward a locking position. An end of the first cable 43 is connected to the back adjusting component 41. The seat component 3 has an accommodating slot 33. The accommodating slot 33 is formed on a lateral wall of the seat component 3 for accommodating the back adjusting component 41. The back adjusting component 41 can be accommodated in the accommodating slot 33 when the back adjusting component 41 is separated from the engaging member 23, so as to constrain a position of the back adjusting component 41 and to prevent the engaging hole 411 on the back adjusting component 41 from aligning with the engaging member 23. The other end of the first cable 43 can be pulled to engage the back adjusting component 41 with the fixing component 2, selectively. The back adjusting component 41 is a curved structure, and an edge of the back adjusting component 41 is an arc structure. In the embodiment, three engaging holes 411 are formed on the edge of the back adjusting component 41. The engaging holes 411 surround a center of the first shaft 21. When the first cable 43 is pulled, the engaging hole 411 on the back adjusting component 41 is separated from the engaging member 23. After the angle of the seat component 3 is adjusted and the first cable 43 is released, the other engaging hole 411 is engaged with the engaging member 23. In the embodiment, the engaging holes 411 have height difference. The back adjusting component further has a track slot 421 communicated with one of the engaging holes 411. The track slot 421 is formed adjacent to the upper engaging hole 411. A pin is substantially parallel to the track slot 412 when the pin passes through the engaging hole 411 to fix the back adjusting component 41 on the lateral side of the seat component 3.

Figure 6:
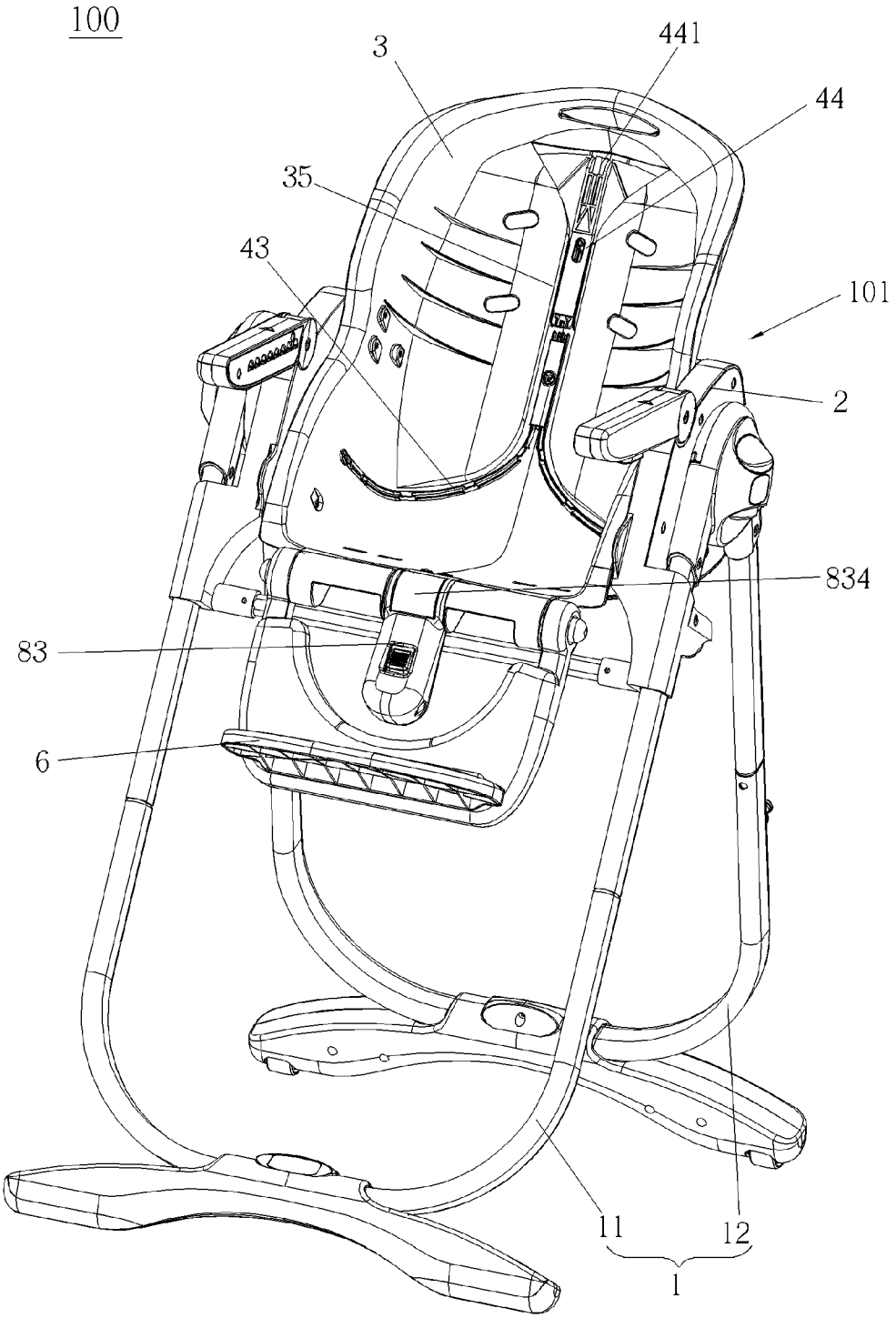
FIG. 6 is a structural diagram of the child chair apparatus without a tray according to the embodiment of the present invention.

Please refer to FIG. 6. The back adjusting mechanism 4 further includes a handle 44 connected to the first cable 43. A cable slot 35 is formed on a back of the seat component 3, and the first cable 43 is disposed on the cable slot 35. The handle 44 is slidably disposed inside the cable slot 35. An operational component 441 is disposed on a top of the handle 44. The operational component 441 can be utilized to pull the first cable 43 conveniently. The first cable 43 is accommodated inside the cable slot 35, which means the first cable 43 can be hidden inside the seat component 3, so as to prevent the back adjusting component 41 from engaging with and separating from the engaging member 23 when the first cable 43 is affected by an accidentally external force.

Figure 7:
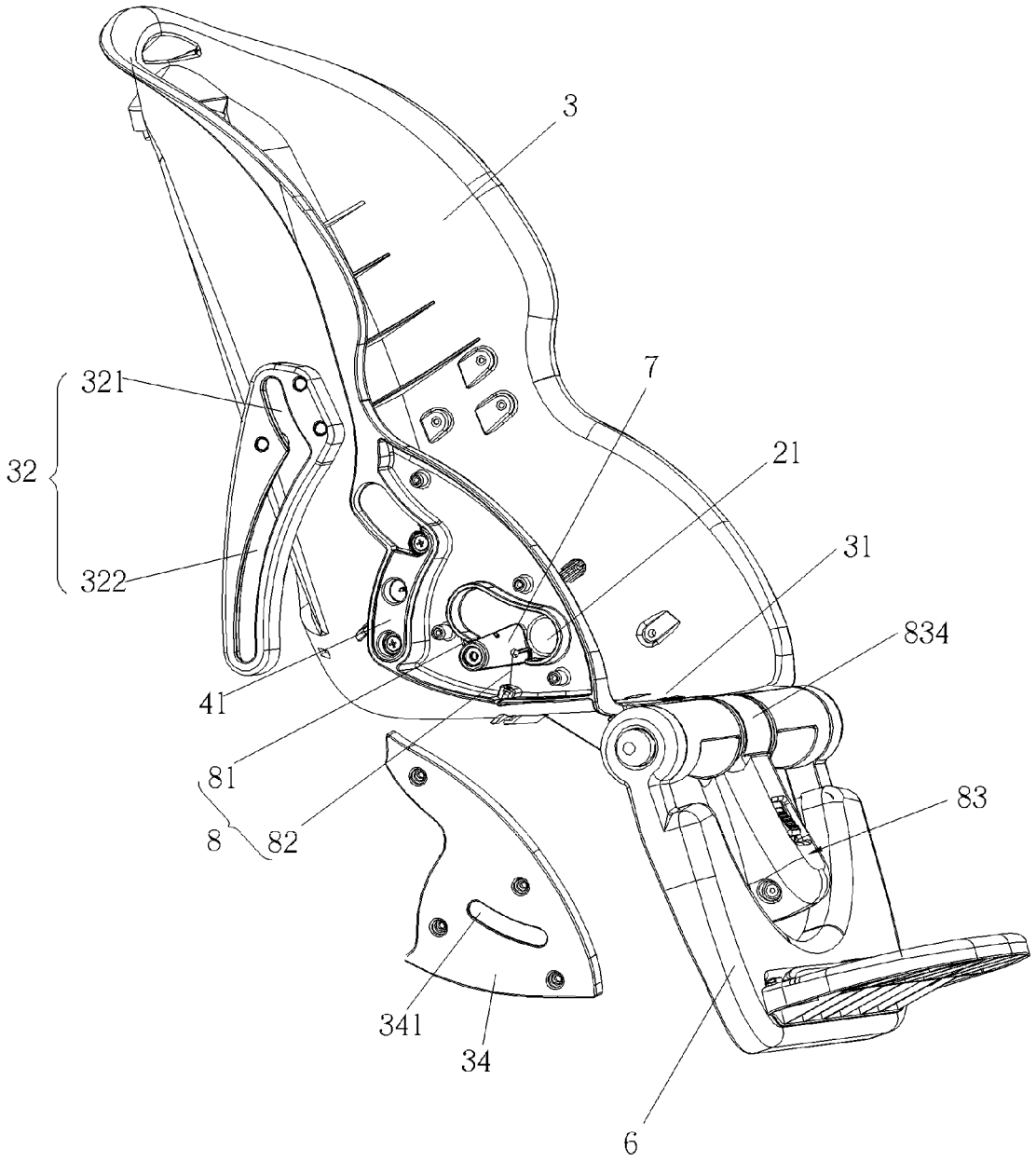
FIG. 7 is a structural diagram of a switching mechanism of the child chare according to the embodiment of the present invention.

As shown in FIG. 7, the first sliding slot 321 is formed on the adjusting base 32. The first sliding slot 321 stretches from the second sliding slot 322 upwardly and makes a turn relative to the second sliding slot 322. The first sliding slot 321 is connected to the second sliding slot 322. The seat device 101 further includes a constraining component 7 and a control mechanism 8. The seat component 3 includes oscillating bases 34. The two oscillating bases 34 are respectively disposed on two sides of the seat component 3. The oscillating base 34 is fixed on the lateral side of the seat portion 31. An oscillating slot 341 is formed on the oscillating base 34, and the first shaft 21 is slidably inserted in the oscillating slot 341. An end of the constraining component 7 is pivotally connected to the seat component 3, and the other end of the constraining component 7 inserts into the oscillating slot 341 to contact against the first shaft 21, so as to constrain a slide of the first shaft 21. The control mechanism 8 can drive the constraining component 7 to move out of the oscillating slot 341 selectively. When the second shaft 22 inserts into the first sliding slot 321, the constraining component 7 can be driven to move out of the oscillating slot 341. Meanwhile, the first shaft 21 is switched from a mode that the first shaft 21 revolves on its center axis to the other mode that the first shaft 21 slides relative to the oscillating slot 341. When the seat component 3 is oscillated, the oscillating slot 341 and the first sliding slot 321 respectively slide relative to the first shaft 21 and the second shaft 22. The first shaft 21 can be locked and unlocked by the control mechanism 8 due to the first sliding slot 321 on the adjusting base 32 and the oscillating slot 341 on the oscillating base 32, the seat component 3 can be oscillated relative to the fixing components 2, and the child chair apparatus 100 can be switched from the high chair to the rocking chair.

Figure 8:
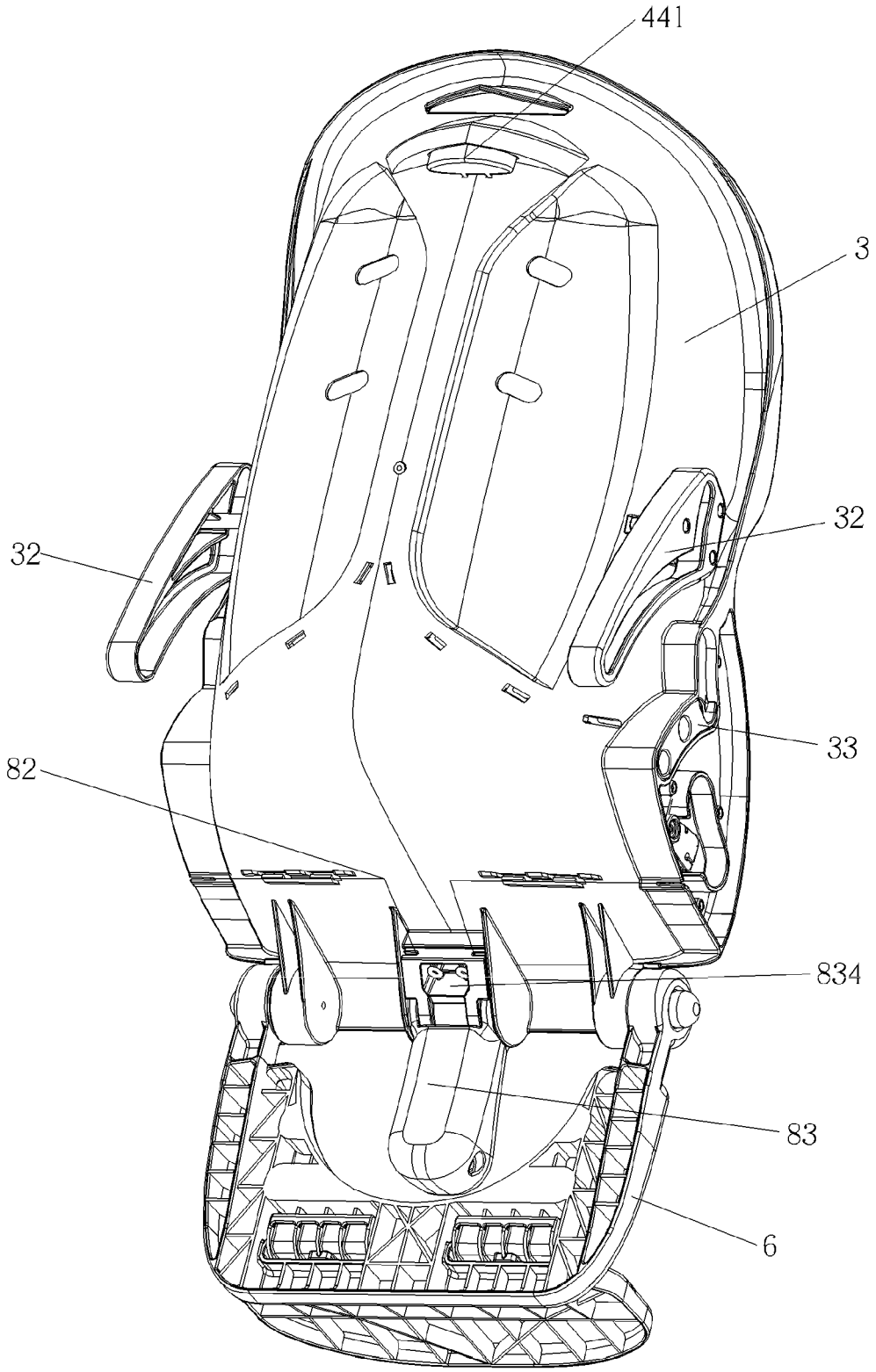
FIG. 8 is the other structural diagram of the switching mechanism of the child chare according to the embodiment of the present invention.

As shown in FIG. 7 and FIG. 8, the control mechanism 8 further includes a second resilient component 81, a second cable 82 and a controlling component 83. The second resilient component 81 can be a torsional spring, and the second cable 82 can be made of steel material. An end of the second resilient component 82 contacts against the seat component 3, and the other end of the second resilient component 82 contacts against the constraining component 7 to drive the constraining component 7 to contact the first shaft 21. An end of the second cable 82 is connected to the constraining component 7, and the other end of the second cable 82 is connected to the controlling component 83. The controlling component 83 controls deformation of the second cable 82. The second cable 82 can be pulled via the controlling component 83 to drive the constraining component 7 to move out of the oscillating slot 341. As the second cable 82 is released, the second resilient component 81 recovers the constraining component 7 to the oscillating slot 341 automatically, so as to effectively lock and unlock the first shaft 21.

Figure 9:
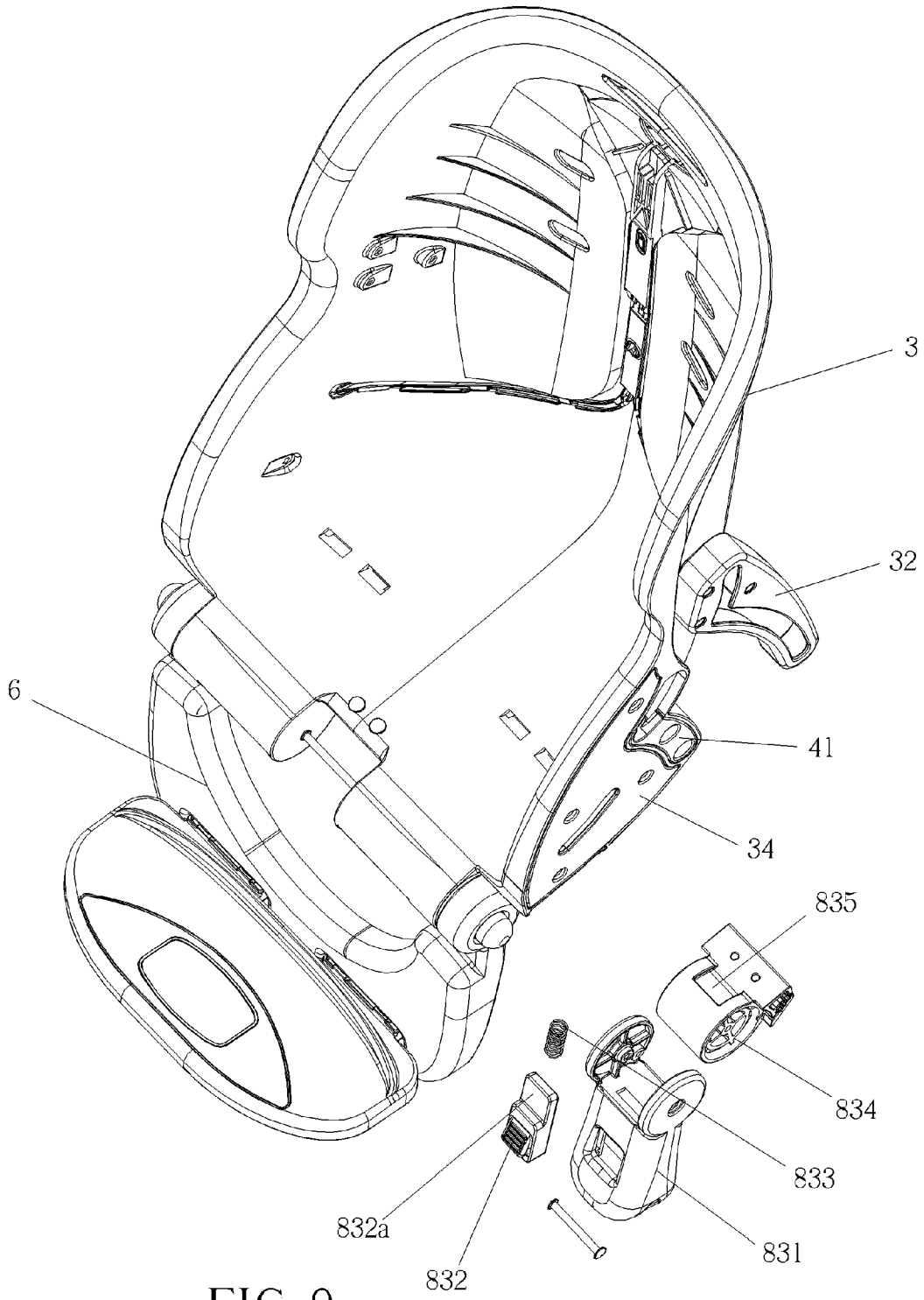
FIG. 9 is an exploded diagram of a controlling component according to the embodiment of the present invention.
Figure 10:
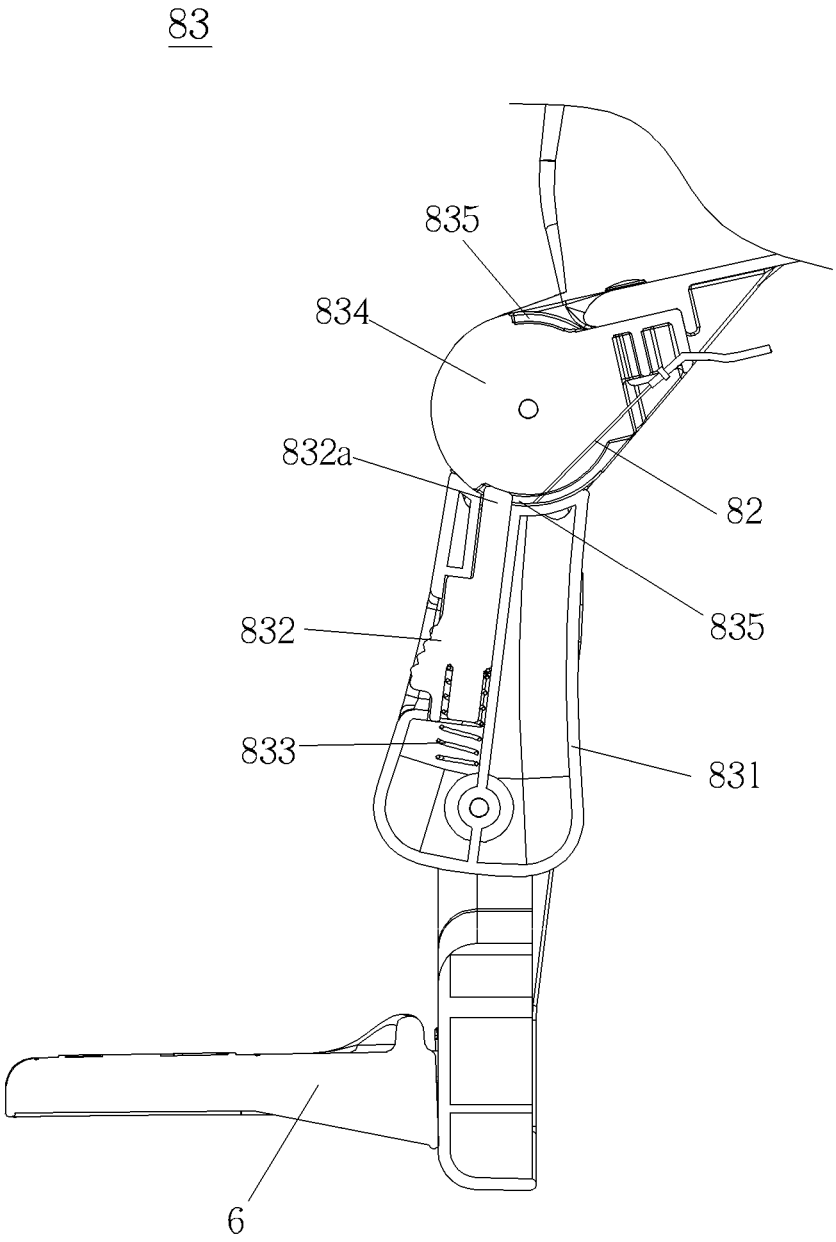
FIG. 10 is a sectional view of the controlling component according to the embodiment of the present invention.

As shown in FIG. 9 and FIG. 10, the controlling component 83 is disposed on a front edge of the seat portion 31 in the embodiment. The controlling component 83 is adjacent to the leg-rest component 6. The controlling component 83 includes a control unit 831, a safety button 823, a recovering spring 833 and a positioning portion 834. The positioning portion 834 is disposed on a front of the seat component 3. The control unit 831 is pivotably disposed on the positioning portion 834. The second cable 82 is connected to the control unit 831. The positioning portion 834 includes positioning holes 835. The positioning holes 835 are formed on a front and a rear end of the positioning portion 834. The safety button 832 is slidably disposed on the control unit 831. The safety button 832 includes an engaging portion 832*a* to be selectively engaged with the positioning hole 835 on the front end or the rear end. The recovering spring 833 is disposed inside the control unit 831. Two ends of the recovering spring 833 respectively contact against the control unit 831 and the safety button 832, and the recovering spring 833 has a trend of driving the safety button 832 to be selectively engaged with the two positioning holes 834. The control unit 831 is pivotally connected to the positioning portion 834, so the second cable 82 is pulled when the control unit 831 rotates relative to the positioning portion 834. The positioning hole 835 is formed on the positioning portion 834, and the safety button 832 can be engaged with the positioning hole 835 to lock the control unit 834. The recovering spring 833 can utilize a resilient force to keep an engagement of the safety button 832 and the positioning hole 835, so as to prevent the safety button 832 from separating from the positioning hole 835. Thus, the control unit 831 does not rotate and the child chair apparatus 100 can be the rocking chair.

Please refer to FIG. 11 to FIG. 14. Working procedure of the child chair apparatus 100 is introduced as following description.

Figure 11:
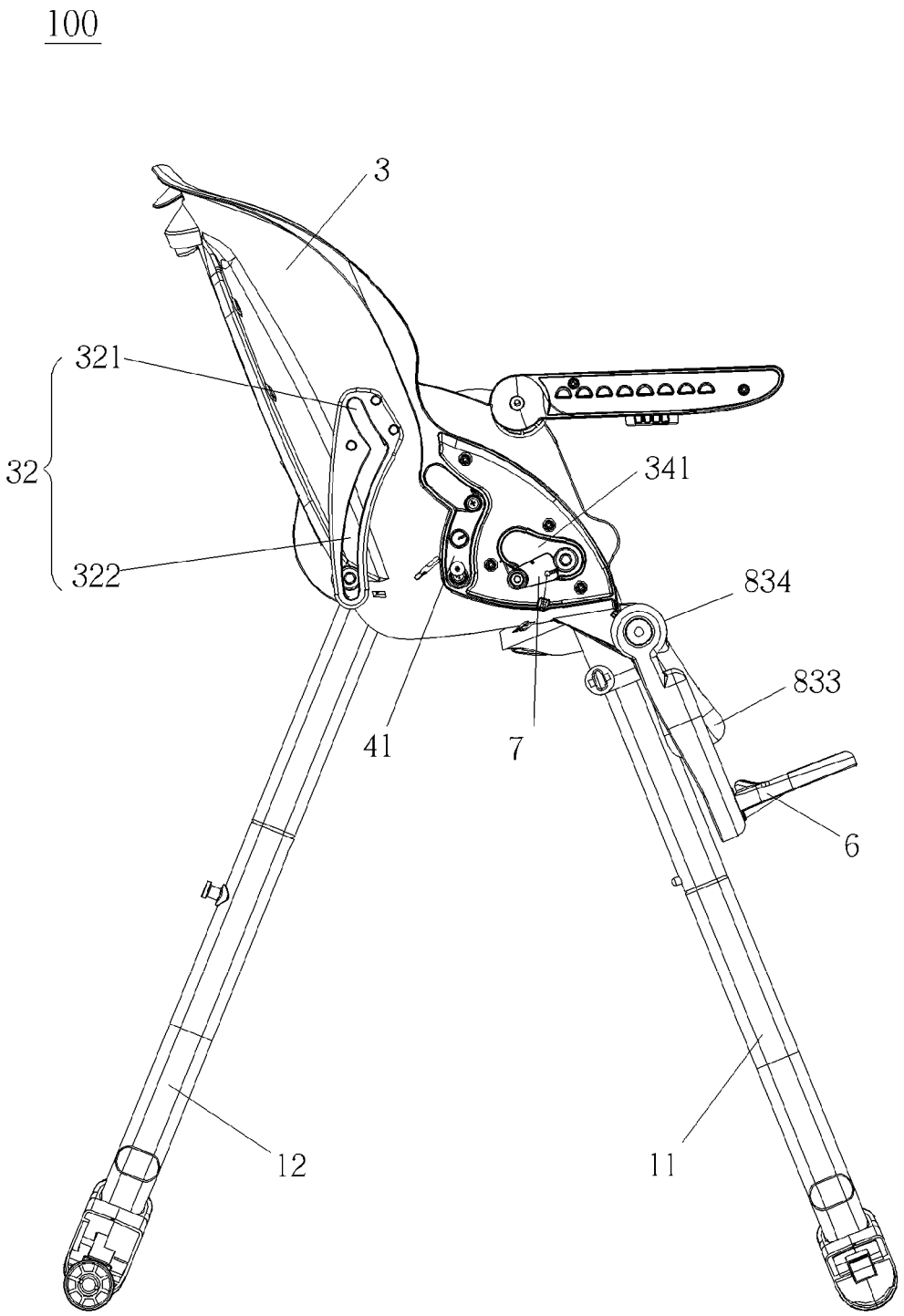
FIG. 11 is a diagram of the back adjusting mechanism according to the embodiment of the present invention.

As shown in FIG. 11, the front foot 11 and the rear foot 12 are unfolded to support the fixing component 2. The seat component 3 is disposed between the fixing components 2. One of the engaging holes 411 on the back adjusting component 41 is capable of being engaged with the engaging member 23 of the fixing component 2. The constraining component 7 inserts into the oscillating slot 341 to contact against the first shaft 21 at an end of the oscillating slot 341, so as to constrain the slide of the first shaft 21 relative to the oscillating slot 341. At the time, the child chair apparatus 100 can be the high chair, and the seat component 3 can be fixed on the fixing component 2 at the specific inclined angle. A constraint portion 51 is disposed on a bottom of the tray 5. When the child chair apparatus 100 is utilized as the high chair, the control unit 831 can not rotate upwardly to prevent the interference. For adjusting the angle of the seat component 3, the operational component 441 of the handle 44 can be pulled, and the handle 44 slides relative to the back of the seat component 3 upwardly. The first cable 43 is driven by the handle 44 to move the back adjusting component 41 into the accommodating slot 33, and the first resilient component 42 is compressed. Meanwhile, the engaging hole 411 is separated from the engaging member 23, the seat component 3 can rotate relative to the first shaft 21, which means that the seat component 3 can rotate relative to the fixing component 2, and the second sliding slot 322 slides relative to the second shaft 22 to adjust the angle of the seat component 3. Angle adjustment of the seat component 3 corresponds to position of the engaging holes 411 on the back adjusting component 41. Three engaging holes 411 are designed in the present invention. The seat component 3 can be adjusted at different angles according user's demand. As the angle adjustment is finished, the engaging hole 411 on the back adjusting component 41 aligns with the engaging member 23, the operational component 441 is released and the handle 44 moves downwardly. The resilient force of the first resilient component 42 moves the back adjusting component 41 to be close to the fixing component 2, so the engaging hole 411 is engaged with the engaging member 23 and the seat component 3 is fixed on the fixing component 2. After the angle adjustment, the seat component 3 can be fixed on the fixing component 2 at the other inclined angle. When the engaging member 23 is engaged with the upper engaging hole 411, the constraining component 7 constrains a movement of the first shaft 21 relative to the oscillating slot 341, and the seat component 3 can be kept at the specific inclined angle.

Figure 12:
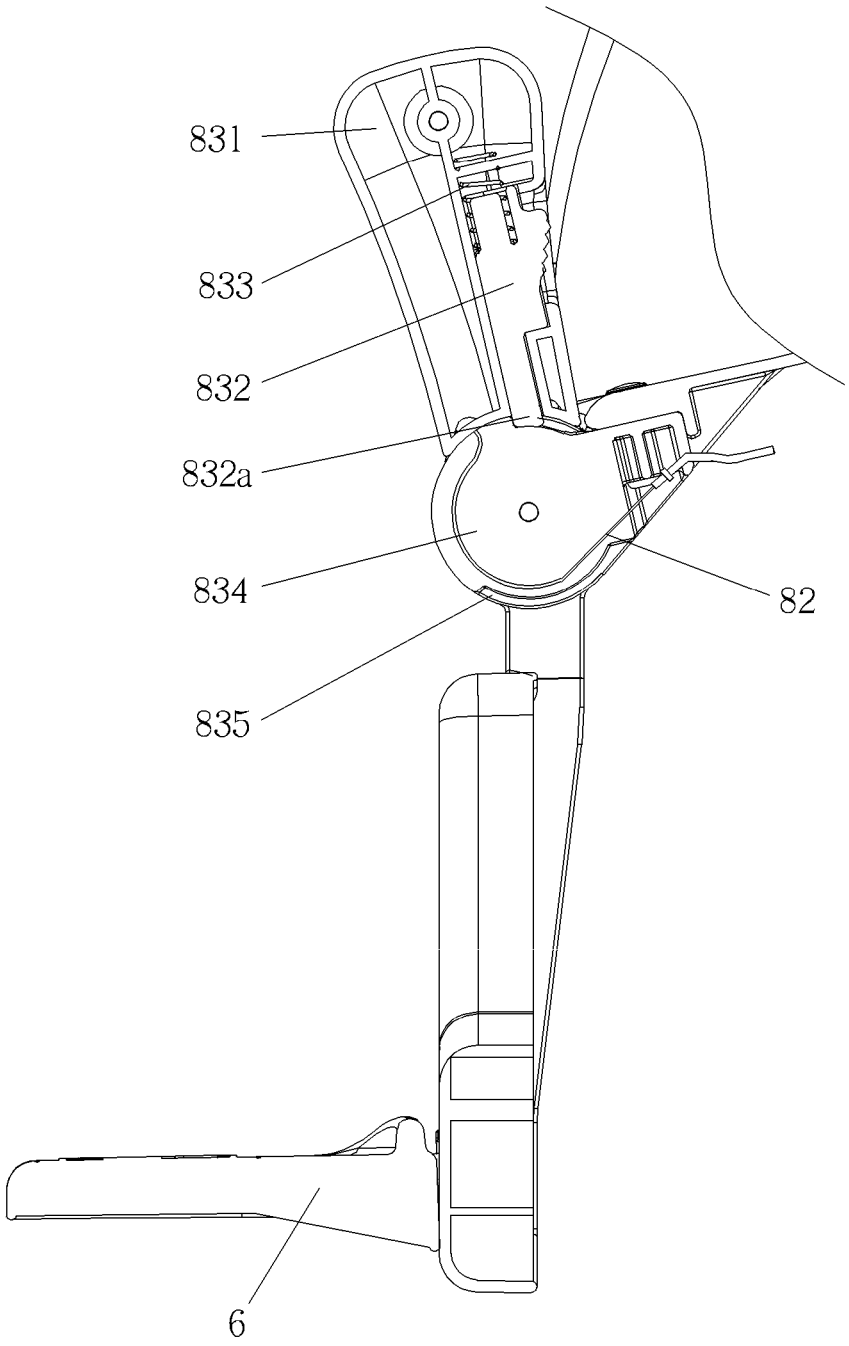
FIG. 12 is a sectional view of the controlling component according to the embodiment of the present invention.
Figure 13:
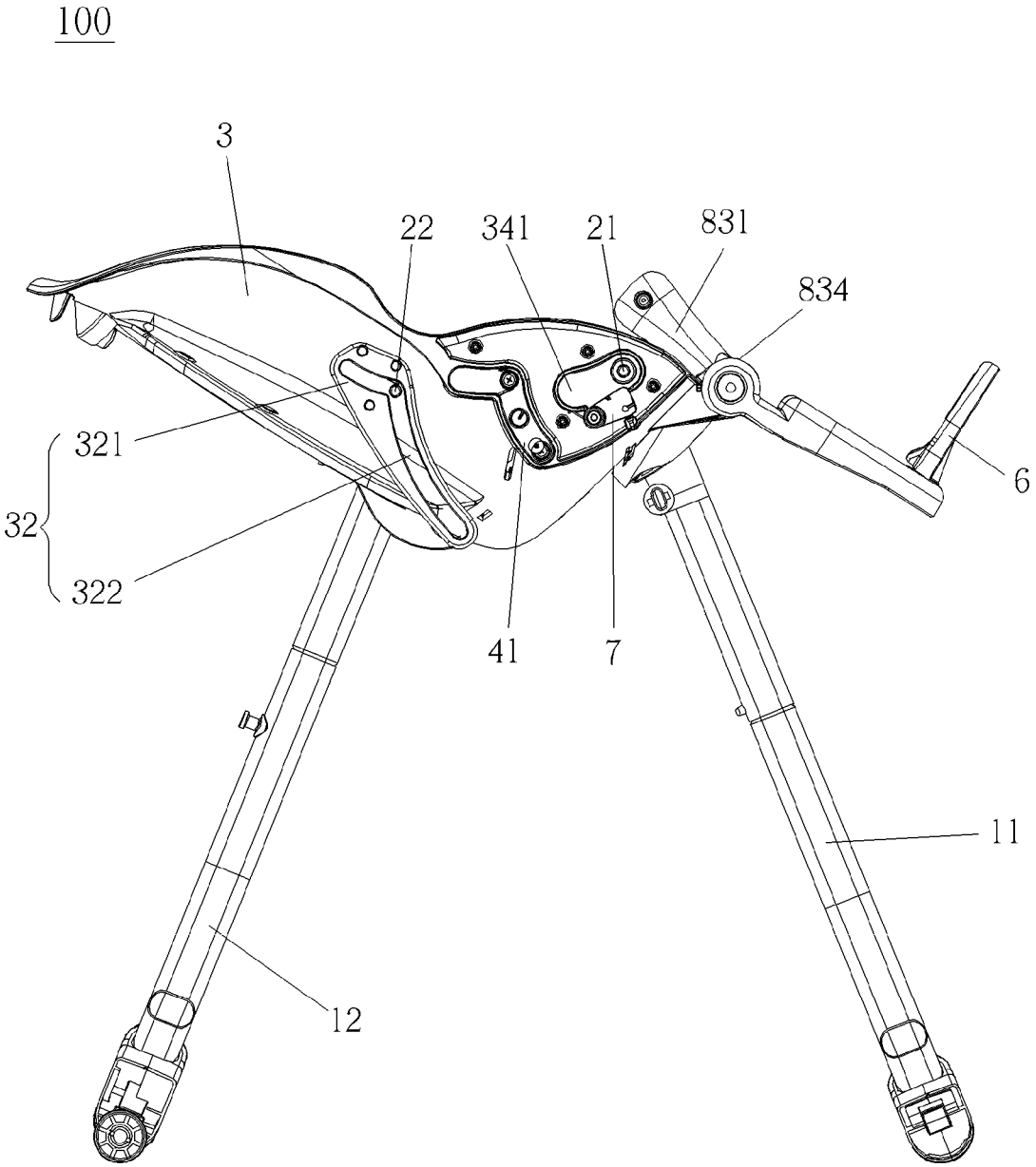
FIG. 13 is a diagram of the switching mechanism of the child chair apparatus according to the embodiment of the present invention.
Figure 14:
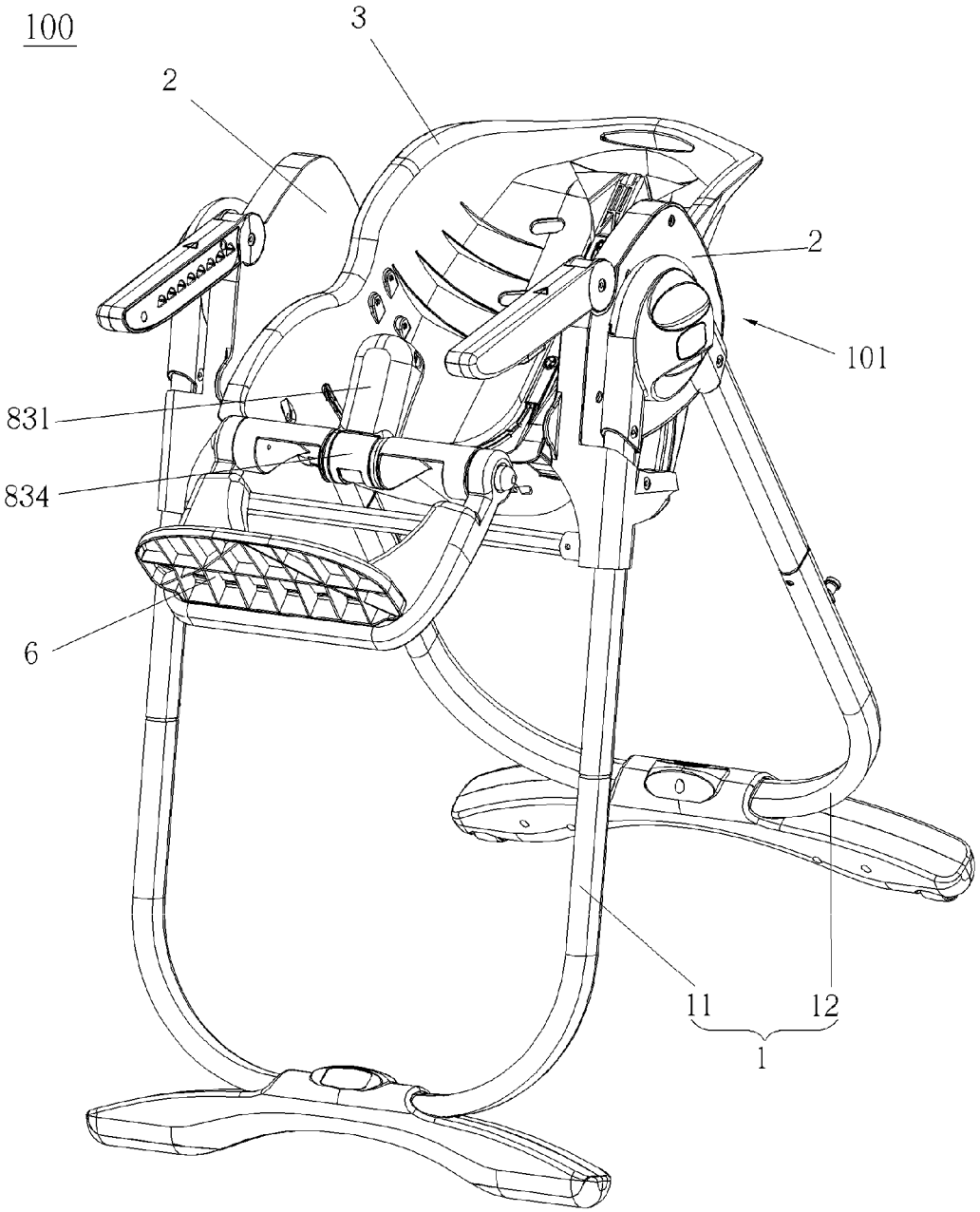
FIG. 14 is a diagram of the child chair apparatus switched to a rocking chair according to the embodiment of the present invention.

As shown in FIG. 12 to FIG. 14, the handle 44 can be pulled to switch the child chair apparatus 100 from the high chair to the rocking chair. The angle of the seat component 3 is adjustable when the engaging hole 441 on the back adjusting component 41 is separated from the engaging member 23. Then, the engaging member 23 is engaged with the last engaging hole 441, the second shaft 22 inserts into the first sliding slot 321, the tray 5 is disassembled from the seat component 3, and the safety button 832 is pressed to slide relative to the control unit 831 downwardly. At the time, the recovering spring 833 is compressed by the safety button 832, the other end of the safety button 832 moves away from the positioning hole 835 on the front end of the positioning portion 834. The control unit 831 is manually driven to rotate relative to the center of the positioning portion 834 from the low side to the upper side. Further, the control unit 831 pulls the second cable 82, the second cable 82 surrounds the positioning portion 834 to move the constraining component 7, and the constraining component 7 can be separated from the oscillating slot 341. The second resilient component 81 is compressed when the constraining component 7 is separated from the oscillating slot 341. Meanwhile, the first shaft 21 is unlocked inside the oscillating slot 341, so the first shaft 21 can slide relative to the oscillating slot 341. Then, the safety button 832 is released. The other end of the safety button 832 inserts into the positioning hole 835 on the rear end of the positioning portion 834 by the resilient force of the recovering spring 833, so as to fix the control unit 831. The first sliding slot 321 and the oscillating slot 341 on the seat component 3 respectively slide relative to the second shaft 22 and the first shaft 21, the engaging member 23 can be capable of sliding inside the track slot 412 without interference, so that the seat component 3 be oscillatory, which means the child chair apparatus 100 is switched to be the rocking chair. For fixing the seat component 3, the first shaft 21 slides to an initial position, and the safety button 832 is pushed. The control unit 831 rotates downwardly to release the second cable 82, the second resilient component 81 utilizes the resilient recovering force to move the constraining component 7 into the oscillating slot 341, the slide of the first shaft 21 is constrained by the constraining component 7, and the seat component 3 can be fixed without oscillation.

The back adjusting mechanism 4 is disposed between the seat component 3 and the fixing component 2. The second sliding slot 322 is formed on the adjusting base 32, the second shaft 22 is slidably disposed inside the second sliding slot 32, and the first shaft 21 is pivotally connected to the front of the seat component 3. The first cable 43 is utilized to separate the back adjusting component 41 from the fixing component 2, so that the second shaft 22 slides inside the second sliding slot 322 and the seat component 3 can rotate relative to the first shaft 21 for position adjustment. Besides, the resilient recovering force of the first resilient component 42 can be utilized to engage the back adjusting component 41 with the fixing component 2 automatically when the position adjustment of the seat component 3 is finished, so as to fix the position of the seat component 3. Further, due to the first sliding slot 321 formed on the adjusting base 32 and the oscillating slot 341 formed on the oscillating base 34, the control mechanism 8 controls the constraining component 7 to move in and to move out of the oscillating slot 341, so as to lock and unlock the first shaft 21. Thus, the seat component 3 can slide relative to the first shaft 21 and the second shaft 22 for oscillation. The present invention has advantages of easy operation and convenient usage. The angle of the seat component 3 is adjusted by pulling the first cable 43, and the child chair apparatus 100 can be switched from the high chair to the rocking chair.

Dimensions and assembly procedures of the tray 5, the front foot 11 and the rear foot 12 of the present invention are omitted herein for simplicity.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child chair apparatus comprising:

a supporting device; and a seat device disposed on the supporting device, the seat device including:

a fixing component disposed on the supporting device, the fixing component including a first shaft and a second shaft;

a seat component including an oscillating component and an adjusting base, the oscillating component and the adjusting base being slidably connected to the first shaft and the second shaft respectively, such that the seat component is slidably disposed on the fixing component, wherein the oscillating component and the adjusting base comprise a constraining slot and a sliding slot respectively, and the first shaft and the second shaft are slidably inserted in the constraining slot and the sliding slot respectively;

a constraining component movably connected to the seat component and operatively interfered with the first shaft; and a control mechanism operatively connected to the constraining component so as to drive the constraining component to be interfered with the first shaft, the control mechanism comprising:

a second resilient component for driving the constraining component to move to an interfering position where the constraining component is interfered with the first shaft;

a second cable; and a controlling component connected to the constraining component via the second cable so as to drive the constraining component to move away from the interfering position.

2. The child chair apparatus of claim 1, wherein the constraining component is pivotally connected to the seat component so as to be driven to move to or move away from the interfering position.

3. The child chair apparatus of claim 1, wherein the controlling component includes a positioning portion fixed on the seat component and having two positioning holes, a control unit pivotally connected to the positioning portion and connected to the second cable and a safety button slidably disposed on the control unit and selectively engaged with the two positioning holes.

4. The child chair apparatus of claim 3, wherein the controlling component further includes a recovering spring contacting against the control unit and the safety button, and the recovering spring drives the safety button to be selectively engaged with the two positioning holes.

5. The child chair apparatus of claim 1, wherein the seat device further includes a back adjusting mechanism disposed on the seat component, the fixing component further includes an engaging member, and the back adjusting mechanism is capable of being engaged with the engaging member when the constraining component is interfered with the first shaft such that the seat component is fixed on the fixing component at a predetermined inclined angle.

6. The child chair apparatus of claim 5, wherein the back adjusting mechanism includes a back adjusting component and a first resilient component contacting against the seat component and the back adjusting component, and the first resilient component drives the back adjusting component to be engaged with the engaging member.

7. The child chair apparatus of claim 6, wherein the back adjusting component has a plurality of engaging holes, and the engaging member is selectively engaged with one of the engaging holes.

8. The child chair apparatus of claim 7, wherein the back adjusting component further has a track slot communicated with one of the engaging holes, and the engaging member is capable of sliding inside the track slot.

9. The child chair apparatus of claim 6, wherein the back adjusting mechanism further includes a first cable and a handle slidably disposed on the seat component and connected to the back adjusting component via the first cable so as to drive the back adjusting component to be disengaged from the engaging member.

10. The child chair apparatus of claim 6, wherein the seat component has an accommodating slot, and the back adjusting component is accommodated in the accommodating slot.

11. The child chair apparatus of claim 1, wherein the sliding slot includes a first sliding slot and a second sliding slot communicated with the first sliding slot, a structural direction of the first sliding slot is different from a structural direction of the second sliding slot, and the second shaft is capable of sliding in the second sliding slot when the constraining component is interfered with the first shaft such that the seat component rotates relative to the fixing component via the first shaft.

12. A child chair apparatus comprising:

a supporting device; and a seat device disposed on the supporting device, the seat device including:

a fixing component disposed on the supporting device, the fixing component including a first shaft and a second shaft; and a seat component having a constraining slot and a sliding slot and including a constraining component, the first shaft being slidably inserted in the constraining slot, the second shaft being slidably inserted in the sliding slot, the constraining component being movably connected to the seat component and capable of being operatively interfered with the first shaft so as to constrain a slide of the first shaft in the constraining slot, the seat component capable of rotating relative to the fixing component via the first shaft when the constraining component is driven to move to an interfering position where the constraining component is interfered with the first shaft such that the child chair apparatus is a high chair, the first shaft and the second shaft being capable of sliding in the constraining slot and the sliding slot respectively when the constraining component is driven to move away from the interfering position such that the child chair apparatus is a rocking chair.

13. The child chair apparatus of claim 12, wherein the sliding slot includes a first sliding slot and a second sliding slot communicated with the first sliding slot, a structural direction of the first sliding slot is different from a structural direction of the second sliding slot, the second shaft is capable of sliding in the second sliding slot when the child chair apparatus is the high chair, the second shaft is capable of sliding in the first sliding slot when the child chair apparatus is the rocking chair.

14. The child chair apparatus of claim 12, wherein the seat device further includes a back adjusting mechanism disposed on the seat component, the fixing component includes an engaging member, and the back adjusting mechanism is capable of being engaged with the engaging member when the child chair apparatus is the high chair such that the seat component is fixed on the fixing component at a predetermined inclined angle.

15. The child chair apparatus of claim 14, wherein the back adjusting mechanism includes a back adjusting component, the back adjusting component has a plurality of engaging holes, and the engaging member is selectively engaged with one of the engaging holes, such that the seat component is fixed on the fixing component at the predetermined inclined angle.

16. The child chair apparatus of claim 12, wherein the seat device further includes a control mechanism, and the control mechanism includes a second cable and a controlling component connected to the constraining component via the second cable so as to drive the constraining component to move away from the interfering position.

17. The child chair apparatus of claim 16, wherein the control mechanism is rotatably disposed on the seat component.

18. The child chair apparatus of claim 12, wherein the constraining component is rotatably disposed on the seat component.

* * * * *